US010886645B2

(12) United States Patent
Bolik et al.

(10) Patent No.: US 10,886,645 B2
(45) Date of Patent: Jan. 5, 2021

(54) CONTACT ELEMENT FOR ELECTRICAL PLUG-IN CONNECTIONS

(71) Applicant: WABCO Europe BVBA, Brussels (BE)

(72) Inventors: Thomas Bolik, Hannover (DE); Juri Harz, Ronnenberg (DE); Tobias Kortlang, Gehrden (DE); Tobias Wustrack, Barsinghausen (DE)

(73) Assignee: WABCO EUROPE BVBA, Brussels (BE)

( * ) Notice: Subject to any disclaimer, the term of this patent is extended or adjusted under 35 U.S.C. 154(b) by 46 days.

(21) Appl. No.: 16/317,759

(22) PCT Filed: Jul. 4, 2017

(86) PCT No.: PCT/EP2017/000787
§ 371 (c)(1),
(2) Date: Jun. 18, 2019

(87) PCT Pub. No.: WO2018/010833
PCT Pub. Date: Jan. 18, 2018

(65) Prior Publication Data

US 2020/0169015 A1 May 28, 2020

(30) Foreign Application Priority Data

Jul. 14, 2016 (DE) ..... 10 2016 008 582

(51) Int. Cl.
*H01R 13/428* (2006.01)
*H01R 12/70* (2011.01)
*H01R 13/24* (2006.01)

(52) U.S. Cl.
CPC ..... *H01R 12/7076* (2013.01); *H01R 13/2407* (2013.01); *H01R 2201/26* (2013.01)

(58) Field of Classification Search
CPC ..... H01R 12/7076; H01R 13/2407; H01R 2201/26
See application file for complete search history.

(56) References Cited

U.S. PATENT DOCUMENTS 5,145,386 A * 9/1992 Berg ..... H01R 12/778 439/83
5,297,970 A * 3/1994 Carney ..... H01R 13/6589 439/108

(Continued)

FOREIGN PATENT DOCUMENTS

DE 3024249 A1 1/1982
DE 3116731 A1 11/1982

(Continued)

OTHER PUBLICATIONS

International Search Report for PCT/EP2017/000787 dated Oct. 18, 2017, 3 pages.

(Continued)

*Primary Examiner* — Truc T Nguyen
(74) *Attorney, Agent, or Firm* — Warner Norcross + Judd LLP

(57) ABSTRACT

A contact element for connection of an electrical plug-in connector of electrical or electronic system components to an electronic printed board assembly is provided herein. The contact element has two mutually spaced arms, each having a circular free end. The arms are connected to one another via a contact portion. At one end, the contact element has an extension piece for the electrical connection to the printed board assembly. The contact element has a cutout over its entire length. The cutout is narrowed in the contact portion by contact projections projecting into the cutout. A clamping region for the force-fitting and electrically conductive clamping of the plug-in connector is formed. The arms are (Continued)

arranged at an angle with respect to the contact portion in such a way that they extend in two different planes.

20 Claims, 3 Drawing Sheets

(56) References Cited

U.S. PATENT DOCUMENTS 6,642,460 B2 * 11/2003 Dunne ..... H01H 1/5805 200/292
9,875,823 B2 * 1/2018 Sasaki ..... H01P 3/085
2001/0049238 A1 12/2001 Brammer et al.
2006/0030191 A1 2/2006 Tuin et al.
2006/0040545 A1 * 2/2006 Neumann-Henneberg ..... H01R 13/112 439/469
2008/0003844 A1 * 1/2008 Polnyi ..... H01R 13/2421 439/66
2009/0035990 A1 * 2/2009 McCarthy ..... H01R 9/0518 439/585
2009/0280689 A1 * 11/2009 Lin ..... H01R 13/2435 439/625
2012/0129362 A1 * 5/2012 Hampo ..... H05K 1/144 439/65
2014/0141661 A1 * 5/2014 Veigel ..... H01R 4/14 439/884
2014/0367838 A1 * 12/2014 Abbott ..... H01L 23/49548 257/676
2015/0189772 A1 * 7/2015 Prajuckamol ..... H01L 23/4006 174/61
2016/0218457 A1 7/2016 Kortlang

FOREIGN PATENT DOCUMENTS

DE 10249683 A1 5/2004
DE 102004040379 A1 3/2006
DE 102013015593 A1 4/2015
EP 2806502 A1 11/2014

OTHER PUBLICATIONS

English language abstract and machine translation for DE3116731 (A1) extracted from http://worldwide.espacenet.com database on Oct. 2, 2018, 11 pages.
English language abstract and machine translation for DE10249683 (A1) extracted from http://worldwide.espacenet.com database on Oct. 2, 2018, 15 pages.
English language abstract and machine translation for DE102004040379 (A1) extracted from http://worldwide.espacenet.com database on Oct. 2, 2018, 10 pages.

* cited by examiner

CONTACT ELEMENT FOR ELECTRICAL PLUG-IN CONNECTIONS

CROSS-REFERENCE TO RELATED APPLICATIONS

This application is a national phase entry of PCT/EP2017/000787, filed Jul. 4, 2017, which claims priority to German Patent Application No. 10 2016 008 582.7, filed Jul. 14, 2016, both of which are incorporated herein by reference in their entirety.

FIELD OF THE DISCLOSURE

The disclosure relates to a contact element for the electrical plug-in connection of electrical or electronic system components to an electronic printed board assembly, such as a printed circuit board, for example, wherein the contact element is made of an electrically conductive material and in which the plug-in connector of the system component can be connected to the contact element in a force-fitting and electrically conductive manner as a result of a spring effect of the contact element. The disclosure moreover relates to a contact device having a plurality of such contact elements.

BACKGROUND

In mechatronic systems, for example in systems of motor vehicles, such as anti-lock brake systems (ABS), electronic brake systems (EBS), automatic or automated gear change devices and clutch control devices, electrical plug-in connections are required to provide electrical signals of system components, such as magnetic coils, sensors or magnetic valves, to one or more electronic control units which are integrated in the overall arrangement of the system, and/or to transmit electrical signals or currents from control units to the system components. Electronic control units are conventionally realized by one or more rigid printed circuit boards or flexible traces, which are also referred to as printed board assemblies. However, generic electrical plug-in connections are also required for establishing contact between system components, for example to provide them with the same electrical ground point.

Wired plug-in connections can be used for this purpose. Although these are flexible in terms of their arrangement, they require relatively complex components for connection arrangements and cable harnesses, which result in high component costs and usually increased arrangement dimensions. Flexible trace foils are less robust and thermally less loadable, which means that they are not universally usable. More favorable in terms of cost, overall size and loadability are known electrical direct connections, such as fork-type plug-in contacts, for instance, which are only a few millimeters in size and are suitable for producing a direct electrical connection between a system component, for example a coil, and a printed circuit board of a control device.

In known plug-in connections, a plug-in tab is plugged into a fork-shaped socket and held mechanically therein as a result of an elastic deformation of a sub-region of the fork. However, this requires a certain normal force, which acts perpendicularly to a bearing surface of the plug-in connector or perpendicularly to the plug-in tab, in order to ensure a mechanically secure plug-in connection and to always maintain electrical contact so that a reliable signal transmission can take place via this connection.

The structure, geometry and overall size of a fork-type contact is determined on the basis that, on the one hand, a necessary spring force has to be provided for maintaining a plug-in connection and, on the other, a plastic deformation of the contact element should be prevented. By the same token, owing to the increasing complexity and number of mechatronic systems, for example advanced driver assistance systems in motor vehicles, there is an increasing demand for the overall size of such electrical plug-in connections to be as compact as possible. In particular, there is a desire for a very flat structure so that it is possible to benefit from even the smallest advantages in terms of space.

DE 10 2013 015 593 A1 discloses a contact system for plug-in connections on electronics housings, having a contact element, formed as a punched part, for contacting mechatronic components on a printed circuit board. The contact element has two arms or contact lugs which are connected to one another by a connecting part, which consists of two webs. A plug-in contact of a mechatronic component can be contacted by a first arm. To this end, this arm has a section with contact projections between which the plug-in contact or a plug-in tab can be clamped in an electrically conductive manner. A second arm is formed to contact the printed circuit board. To produce a flexible connection between the contact arms, the two connecting webs are formed in a zigzag shape. Both arms are bent through approximately 90° with respect to the connecting part, wherein both arms on the connecting part can be angled in the same direction or in opposite directions. The connecting part extends approximately parallel to the plane of the printed circuit board. The arms therefore extend approximately perpendicularly to the plane of the printed circuit board. The overall height of the plug-in connection is determined substantially by the length of the arms. A similar contact element is disclosed in DE 30 24 249 A1.

US 2000/0 049 238 A1 discloses an electrical plug-in contact, consisting of a plug-in zone for receiving a plug-in connector, a connecting zone for the electrical connection of the plug-in contact to an electrical component, and an intermediate zone which is arranged between the plug-in zone and the connecting zone. The plug-in zone is formed as a fork-like socket into which a plug-in tab of the plug-in connector can be plugged, wherein the fork-type contact is widened so that the plug-in tab is held as a result of the spring effect of the material of the fork-type contact. The plug-in zone is arranged in an L-shaped region of the plug-in contact. The plug-in contact is angled a plurality of times in an S-shape in the region of the connecting zone and/or the intermediate zone. The overall height of the plug-in contact is determined substantially by the length of the limbs of the L shape.

BRIEF SUMMARY

The disclosure provides a contact element for electrical plug-in connections on mechatronic systems which may have a reduced, in certain embodiments flatter, overall height, yet may ensure a secure and continuous electrical connection of the components to be connected and is economical to manufacture. In particular, such a contact device may be suitable for reliable contacting of mechatronic systems in motor vehicles. Moreover, a contact device composed of a plurality of such contact elements may also be proposed.

A contact element for connection of an electrical plug-in connector of electrical or electronic system components to an electronic printed board assembly is provided herein. The contact element includes a first arm and a second arm. The two arms each have a circular free end. The two arms are connected to one another via a contact portion. At one end, the contact element has an extension piece for the electrical connection to the printed board assembly. The contact element has a cutout over its entire length. The cutout is narrowed in the contact portion by contact projections projecting into the cutout. A clamping region for the force-fitting and electrically conductive clamping of the plug-in connector of the system component is formed. The two arms are arranged at an angle with respect to the contact portion in such a way that they extend in two different planes.

In certain embodiments, the disclosure is based on the recognition that, in the case of a contact device for electrical plug-in connections in mechatronic systems, a fork-shaped electrical contact element can be designed such that it is angled in two directions so as to realize a particularly flat structure. With a relatively narrowly spaced double bending of a contact element, which has been formed from a metal material such as a thin metal sheet, however, a disadvantageous material stiffening occurs in the region in which the angles are formed. This material stiffening leads to a considerable reduction in a spring effect of the material so that a plug-in tab which is plugged into the fork-type contact and should then be held as a result of the spring effect of the material would not be adequately secured in a conventional contact element without further measures.

In various embodiments, the aim is to compensate the inadequate spring effect caused by the intrinsically desired angled form by resilient regions which, although they lie outside the angled regions, still act resiliently on the contact or clamping portion of the contact element. As a result of a geometrically novel construction of such a contact element, paying particular attention to the spring effect to be achieved, it is possible, in spite of the double angled form and reduced overall height, to achieve a spring effect in the contact or clamping portion of the contact element which is comparable to that of conventional generic contact elements.

The disclosure therefore starts with a contact element for the electrical plug-in connection of electrical or electronic system components to an electronic printed board assembly, such as a printed circuit board, for example, wherein the contact element is made of an electrically conductive material and in which the plug-in connector of the system component can be connected to the contact element in a force-fitting and electrically conductive manner as a result of a spring effect of the contact element.

To achieve the object, the disclosure provides that the contact element has two mutually spaced arms, that the two arms each have a circular free end, that the two arms are connected to one another via a contact portion, that, at one end, the contact element has an extension piece for the electrical connection to the printed board assembly, that the contact element has a cutout over its entire length, that the cutout is narrowed in the contact portion by contact projections projecting into the cutout, whereby a clamping region for the force-fitting and electrically conductive clamping of the plug-in connector of the system component is formed, and in which the two arms are arranged at an angle with respect to the contact portion in such a way that they extend in two different planes.

A twice-bent, economically producible contact element with a comparatively small installation height is provided by the disclosure. A normal contact force required for securely holding a plug-in connector by the spring effect of the contact element is achieved by a special construction of the arms of the contact element. Accordingly, in contrast to previous fork-type contacts, a fork-shaped contact portion is proposed, which, following each longitudinally extending side, is elongated by a respective angled or bent arm. The arms have a circular portion at their free ends and the contact portion and the arms have a cutout which extends over the entire length of the contact element. Owing to this cutout, the two arms each includes, consists essentially of, or consists of, two substantially mutually parallel arranged limbs and the contact portion also has two substantially mutually parallel limbs. The cutout is designed such that it narrows in the contact portion and, more precisely, in such a way that this narrowing has a width which is smaller than the thickness of an electrical plug-in connector of a system component to be contacted.

The disclosure provides a configuration for a contact element which meets the requirements of a compact, in certain embodiments very flat structure on the one hand and a high spring force in the normal direction of a plug-in connector on the other. In this case, a contact element having a longitudinally directed cutout is produced, which has two bent arms on both sides of a contact portion, which each have a annular free end. The internally open contact element, which can be produced as a punched part and has a curved contour, extends between the ends of the arms. When the arms are pressed apart, the circular ends of the contact element generate a spring force which wants to restore the contact portion arms to their starting position. In this case, compared to an angular form of the ends of the arms of the contact element, the annular geometry thereof advantageously prevents the production of notch stresses.

This construction of the contact element can generate a spring force when the plug-in connector of a system component to be contacted is introduced into the narrowing in the contact portion. In this case, the limbs of the arms are pressed apart and their inherent restoring effect generates a normal force acting on the plug-in connector which holds this latter on the contact element.

In this case, the contact portion of the contact element is aligned so that a plug-in connector of a system component, for example a protruding plug-in tab on an electrical coil, is aligned approximately perpendicularly to the plane of the contact portion and thereby penetrates this latter. The contact portion is therefore aligned approximately in the plug-in direction of the plug-in connector so that the plug-in connector can be easily plugged into the contact element.

The double angled form of the contact element can be adapted to the respective structural properties of an application. To this end, it can be provided that the first arm and the second arm are aligned at an angle with respect to the contact portion of the contact element, each in an angular range of 30° to 120°, including the range limits, wherein both angles can be formed to be the same size or different sizes.

According to one embodiment of the contact element, it can be provided that the first arm is bent through approximately 90° with respect to the contact portion of the contact element and extends approximately parallel to a plane of the system component to be contacted, and that the second arm is bent through approximately 90° in the opposite direction to the first arm with respect to the contact portion and extends approximately parallel to a plane of the printed board assembly, i.e. a printed circuit board, for example, and that the plug-in connector can be plugged into the contact portion approximately perpendicularly to the two arms.

Another further development of the disclosure provides that, owing to the cutout in the contact element, the two arms and the contact portion are each formed by two limbs and that the geometry of the limbs and the ends thereof enables a spring force to be generated, which, in the region of the contact portion, acts on a plug-in connector of the system component, which is received in the contact portion.

It can moreover be provided that, in the region of the contact portion, the arms or their limbs have insertion chamfers for easier insertion of a plug-in connector of a system component into the contact element, wherein the insertion chamfers narrow the cutout in the contact element continuously with a sloping progression.

By employing the contact projections, a comparatively high surface pressure can be exerted on the plug-in connecter of a system component which is to be contacted. The spring force provided by the contact element on the plug-in connector in the normal direction is thus used particularly effectively to hold the plug-in connector in the contact portion. Owing to the angled form of the contact element, the contact portion can be aligned precisely in the plug-in direction of the plug-in connector. Since the plug-in direction of the plug-in connector is in the contact plane of the contact portion, an advantageous insertion chamfer for the plug-in connector can be formed via the contact projections. The plugging-in of the plug-in connector when assembling the plug-in connection can thus be carried out particularly easily and securely.

According to another embodiment of the disclosure, it can be provided that the contact element is arranged on a supporting element, wherein the ends of the arms are fixed on the supporting element by latching connections, and that the supporting element has at least one opening for guiding the plug-in connector of a system component through into the contact portion of the contact element.

The plug-in connection is given particularly good stability by a supporting element. This can be advantageous in particular in sensitive systems which are exposed to constant vibrations or shocks. Moreover, such a supporting element enables the compensation of assembly and manufacturing tolerances of the plug-in connection or the components to be contacted. To fix the contact element on the supporting element, latching elements, onto which the annularly formed ends of the contact element can be easily pushed with a slight radial play, can be attached to the housing or formed thereon. The radial play is designed such that it does not adversely affect the contribution of the ends of the contact element to the potential spring force thereof.

According to a further embodiment, it can be provided that the extension piece at the end of the contact element is formed for direct attachment to and contact with a component of the printed board assembly, such as a lead frame. Lead frames are frequently used individually or also stacked as particularly compact distributors of electrical currents and signals in complex control devices of mechatronic systems. By employing a simple, for example rod-shaped or plate-shaped, extension piece on the contact element, a permanent direct connection between the contact element and a lead frame or a similar printed-circuit-board type part of a printed board assembly and components arranged thereon can be produced simply and economically.

The contact device according to the disclosure enables the construction of a standard connecting plug, which generates a high spring force for securely holding a plug-in connector over the whole of the envisaged useful life of the respective device, but has a reduced height compared to existing systems. A contact element formed according to the disclosure can have a length of about 2.6 mm to about 3.0 mm and a height of about 0.6 mm to about 1.0 mm, for example.

According to another embodiment, it can be provided that the extension piece on the contact element is formed with an angle, wherein the angled portion is longer than the non-angled portion of the extension piece. In certain embodiments, contacts on the printed board assembly which are arranged laterally adjacent and remote from the contact element may be provided.

The disclosure also relates to a contact device having a plurality of contact elements, as described above, wherein a plurality of contact elements are arranged for a plurality of electrical contacts or for a plurality of phases of an electrical contact, wherein these contact elements are orientated in the same directions in terms of the angle of their arms so that their extension pieces point in the same directions. The associated contact a printed board assembly can thus be realized particularly easily.

According to an alternative embodiment of such a contact device, it is provided that a plurality of contact elements are arranged for a plurality of electrical contacts or for a plurality of phases of an electrical contact, wherein these contact elements are orientated in opposite directions in terms of the angle of their arms so that their extension pieces point in opposite directions. This enables contacting of the associated contact of two printed board assemblies, i.e. two printed circuit boards, for example, which are arranged on opposite sides, near to the extension-piece ends of the respective contact elements.

A multiplicity of electrical plug-in connections can be provided in a mechatronic system. The contact element according to the disclosure can therefore be advantageously installed in any number and arrangement. In this case, a reduced size of the overall system can be achieved by an appropriate alignment of the contact devices.

Further embodiments of the disclosure provide that the two arms and the contact portion are each formed by two limbs and a first limb of a first arm is connected to a first limb of a second arm via a first limb of a first contact portion and a second limb of a first arm is connected to a second limb of a second arm via a second limb of a second contact portion.

It can furthermore be provided that the first limb of the first arm is connected in one piece to the first limb of the second arm via the first limb of the first contact portion and the second limb of the first arm is connected in one piece to the second limb of the second arm via the second limb of the second contact portion.

It can furthermore be provided that the two arms can be connected to one another in one piece via the contact portion. It should be understood from this that, after the clamping of the plug-in connector of the electronic system component, there is direct contact between the limbs of the two arms via the limbs of the contact portion. It can furthermore be provided that the two arms are connected to one another in one piece via the contact portion.

BRIEF DESCRIPTION OF THE DRAWING

The invention is described in greater detail below with reference to the accompanying figures, in which.

DETAILED DESCRIPTION

Figure 1:
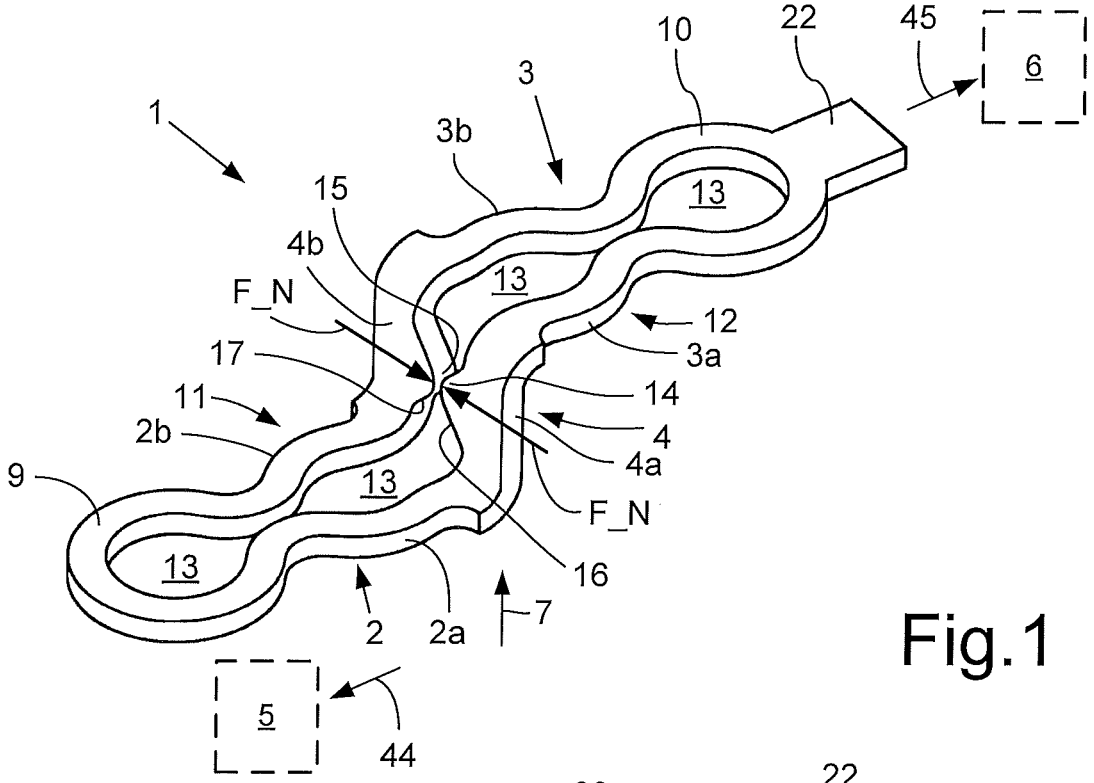
FIG. 1 shows a perspective view of a contact element according to a first embodiment.

With reference to the specific embodiment of the figures, wherein like numerals generally indicate like parts throughout the several views, the contact element 1 shown in FIG. 1 is provided for use in a contact device for electrical plug-in connections, for example in a mechatronic system. It has been punched from a metal, electrically conductive material in the form of a thin metal sheet and subsequently or simultaneously bent. The contact element 1 has an elongated stepped geometry with a contour which has multiple curves.

The contact element 1 has two arms 2, 3 which are connected to one another via a contact portion 4 formed between them. Moreover, the contact element 1 has a cutout 13 which extends over its entire length. As a result of the cutout 13, the arms 2, 3 are each formed by two limbs 2*a*, 2*b*; 3*a*, 3*b* and the contact portion 4 also includes, consists essentially of, or consists of, two limbs 4*a*, 4*b*. The two limbs 4*a*, 4*b* of the contact portion 4 narrow the cutout 13 to a slight gap for here receiving a plug-in connector 8*a*, 8*b* of an element to be contacted and clamping it in an electrically conductive manner.

The two arms 2, 3 start at the contact portion 4 and are aligned at an angle on this in two directions, in each case through 90°. The first arm 2 therefore extends approximately in the direction of the longitudinal extent 44 of a system component 5 to be contacted, for example an electrical coil or a sensor, and the second arm 3 extends approximately in the direction of the longitudinal extent 45 of a component of a printed board assembly 6, for example a printed circuit board. The contact portion 4 extends approximately in the plug-in direction 7 of the plug-in connector 8*a*, 8*b* of the system component 5 (see FIG. 4 and FIG. 5).

In the region of the contact portion 4 of the contact element 1, two contact projections 14, 15 projecting inwardly into the cutout 13 are formed on the contact element for clamping the plug-in connector 8*a*, 8*b* to be received there on two sides. The two contact projections 14, 15 are formed with insertion chamfers 16, 17 in the plug-in direction 7 for easier insertion of a plug-in connector 8*a*, 8*b* and are operative in this direction.

Figure 4:
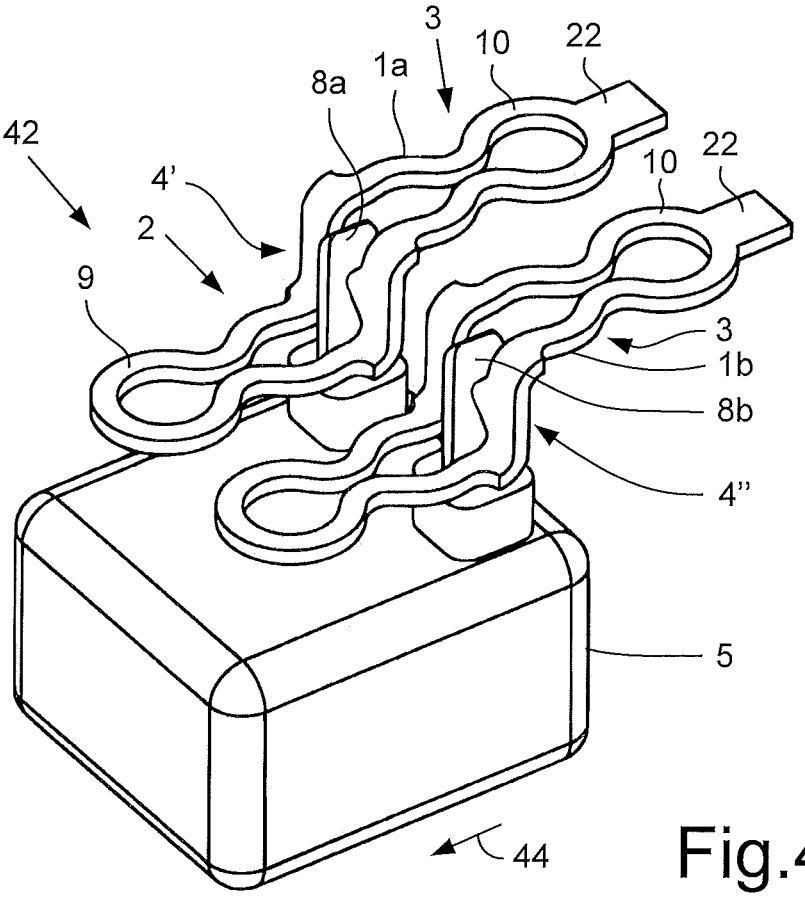
FIG. 4 shows a perspective view of two contact elements aligned in the same direction, which are connected to plug-in connectors.
Figure 5:
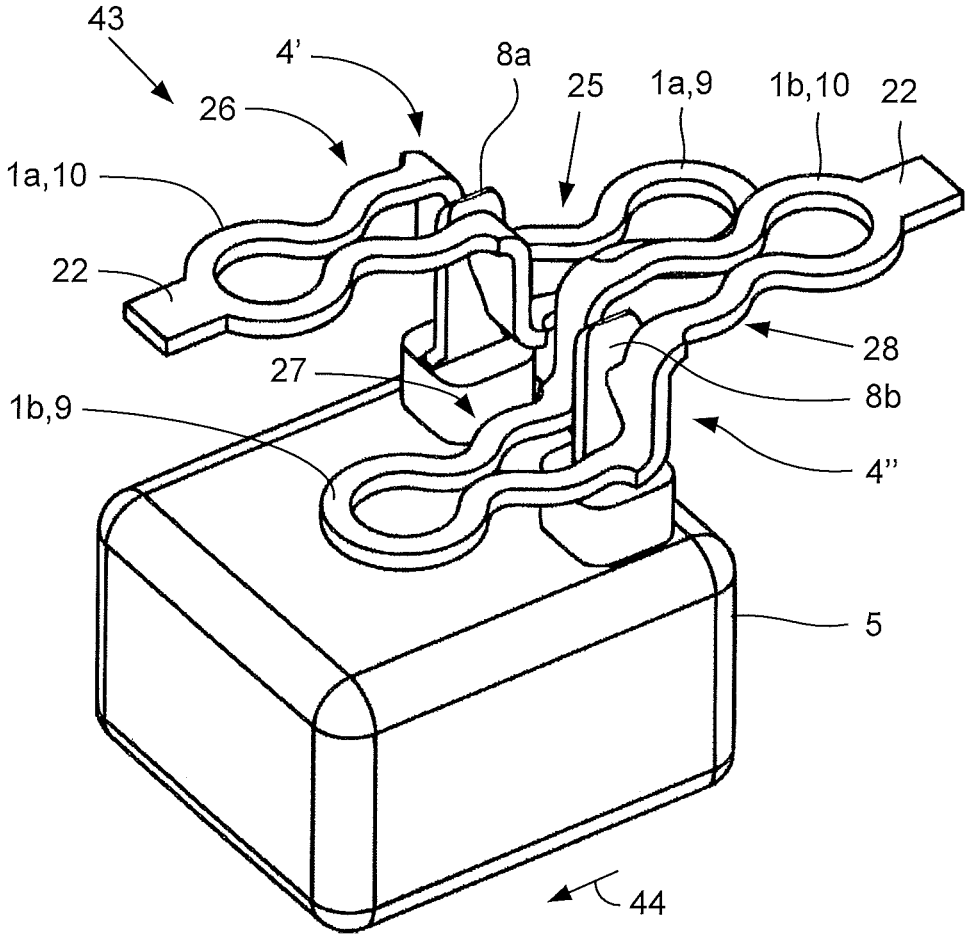
FIG. 5 shows a perspective view of two contact elements aligned in opposite directions, which are connected to plug-in connectors.

The two arms 2, 3 have annular ends 9, 10 which point away from the contact portion 4. The cutout 13 in the contact element 1 extends into the circular ends 9, 10. An intermediate region 11, 12, which has a curved contour and is formed as a spring region, extends between the two ends 9, 10 and the contact portion 4 in each case. The two circular ends 9, 10 of the arms 2, 3 and the two spring regions 11, 12 are formed and cooperate in such a way that the contact element 1 as a whole has spring properties. When a plug-in connector 8*a*, 8*b* is plugged in between the two contact projections 14, 15 in the plane of the contact portion 4, this spring property of the contact element 1 generates a spring force F_N, which is directed inwards and thereby clamps, holds and establishes continuous electrical contact with the plug-in connector 8*a*, 8*b* in the cutout 13 (FIGS. 4 and 5).

Moreover, a rod-shaped or plate-shaped extension piece 22 is arranged or formed at the end 10 of that second arm 3 which is provided for attachment to the printed board assembly 6, which extension piece can be connected to a printed circuit board or a lead frame with press fit, for example. With a varying geometrical shape, the extension piece 22 enables a wide variety of different contacts to be electrically and mechanically attached there. These other contacts can be press-in contacts, soldered contacts or a bonding pad for a bonding wire connection, for example.

Figure 2:
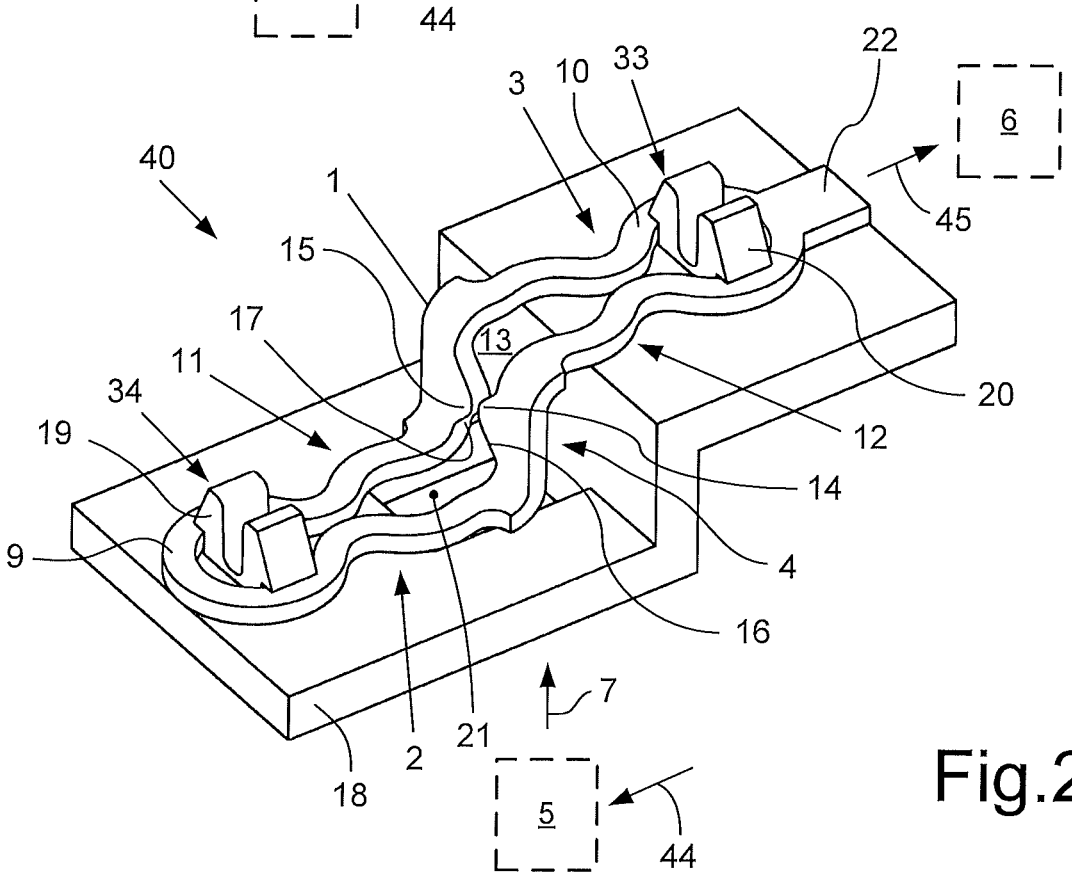
FIG. 2 shows a perspective view of the contact element according to FIG. 1, which is attached to a supporting element.

As shown in FIG. 2, in the case of the contact device 40 therein, the annular ends 9, 10 of the arms 2, 3 of the contact element 1 can be used for a first latching connection 33 and a second latching connection 34 to a supporting element 18. To this end, a respective latching element 19, 20 is latched to an associated annular end 9, 10 of the arms 2, 3 with a slight radial play. The two latching elements 19, 20 are arranged in an appropriate position for this on the supporting element 18 and are fixedly connected thereto, for example produced in one piece therewith.

In terms of its surface, the supporting element 18 is clearly adapted to the angled form and to the contact portion 4 of the contact element 1 and to the geometry of the arms 2, 3 and, in the exemplary embodiment shown, is designed as a stepped plate with the appropriate geometry. Moreover, the supporting element 18 has an opening 21, which serves as a passage for a plug-in connector 8*a*, 8*b* of a system component 5 to be contacted. The supporting element 18 can be provided for attachment to associated base plates or surfaces which support the components to be electrically connected by the contact element 1. However, the supporting element 18 can also be formed as a contacting module, a housing or part of a housing, for instance a housing cover, a housing wall or a housing base.

Figure 3:
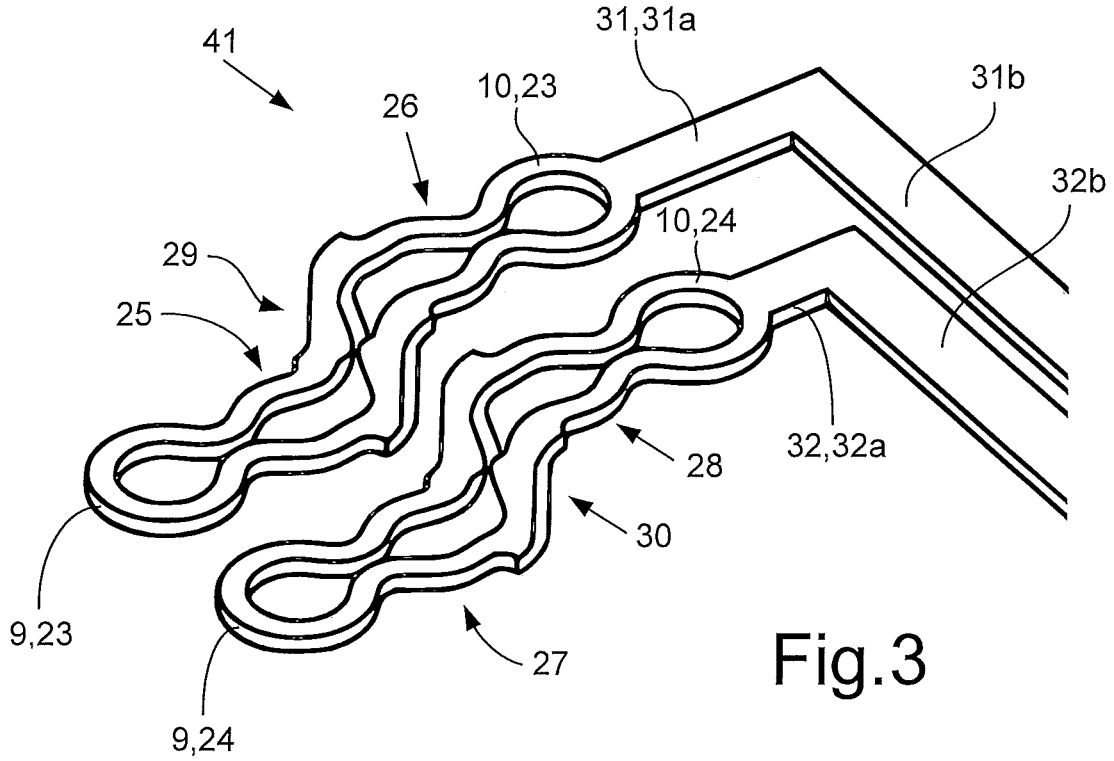
FIG. 3 shows a perspective view of two contact elements with long extension pieces according to a second embodiment.

FIG. 3 shows a second contact device 41 having two contact elements 23, 24 which are formed substantially in the manner of the contact element 1 according to FIG. 1. Each of these two contact elements 23, 24 therefore has a first two-limbed arm 25, 27 and second two-limbed arm 26, 28, which are connected to one another via a separate two-limbed contact portion 29, 30 in each case. The second arms 26, 28 on the printed-circuit-board side are provided with elongated extension pieces 31, 32. These elongated extension pieces 31, 32 are each aligned such that they are angled through 90° in the plane of the arms 26, 28 connected thereto and can be connected for example to a lead frame (not illustrated). It can be seen in each case that the portion 31*b*, 32*b* of the extension piece 31, 32 which is angled away from the contact element 23, 24 is longer than the non-angled portion 31*a*, 32*a*. The two contact elements 23, 24 can thus be arranged parallel next to one another and connected via the respective extension pieces 31, 32 to another component or a printed circuit board or a lead frame which, in terms of the alignment of its contact points, is likewise aligned parallel to the contact elements 23, 24.

FIG. 4 shows a third contact device 42 having two contact elements 1*a*, 1*b* which are formed in the manner of the contact element 1 according to FIG. 1. These two contact elements 1*a*, 1*b* are aligned parallel and in the same direction with respect to one another and to a system component 5, which is illustrated as a coil housing of an electrical coil here. This system component 5 has two electrical plug-in connectors 8*a*, 8*b*, which are formed as plug-in tabs, and are plugged into, and clamped in, the respective contact portions 4', 4" of the associated contact elements 1*a*, 1*b* in an electrically conductive manner. In this case, contact is established for example by a movement of the two contact elements 1*a*, 1*b* in the direction of the system component 5 or, alternatively, by a movement of the system component 5 towards the two contact elements 1*a*, 1*b*. In this case, to realize functional contacting, it is not important whether the system component 5 is arranged as illustrated in FIG. 4 or rotated through 180° about its vertical axis. In the latter case, the housing of the system component 5 would be arranged below the second arms 3 of the two contact elements 1*a*, 1*b*.

Finally, FIG. 5 shows a fourth contact device 43 similar to that according to FIG. 4, although in which the two contact elements 1*a*, 1*b* are aligned in opposite directions. It is clear that the respective extension pieces 22 therefore point in opposite directions whilst the two plug-in connectors 8*a*, 8*b* of the system component 5 are plugged into, and clamped in, the respective contact portions 4', 4" of the associated contact elements 1*a*, 1*b* in an electrically conductive manner.

The terms "comprising" or "comprise" are used herein in their broadest sense to mean and encompass the notions of "including," "include," "consist(ing) essentially of," and "consist(ing) of. The use of "for example," "e.g.," "such as," and "including" to list illustrative examples does not limit to only the listed examples. Thus, "for example" or "such as" means "for example, but not limited to" or "such as, but not limited to" and encompasses other similar or equivalent examples. The term "about" as used herein serves to reasonably encompass or describe minor variations in numerical values measured by instrumental analysis or as a result of sample handling. Such minor variations may be in the order of ±0-25, ±0-10, ±0-5, or ±0-2.5, % of the numerical values. Further, The term "about" applies to both numerical values when associated with a range of values. Moreover, the term "about" may apply to numerical values even when not explicitly stated.

Generally, as used herein a hyphen "-" or dash "-" in a range of values is "to" or "through"; a ">" is "above" or "greater-than"; a "≥" is "at least" or "greater-than or equal to"; a "<" is "below" or "less-than"; and a "≤" is "at most" or "less-than or equal to." On an individual basis, each of the aforementioned applications for patent, patents, and/or patent application publications, is expressly incorporated herein by reference in its entirety in one or more non-limiting embodiments.

It is to be understood that the appended claims are not limited to express and particular compounds, compositions, or methods described in the detailed description, which may vary between particular embodiments which fall within the scope of the appended claims. With respect to any Markush groups relied upon herein for describing particular features or aspects of various embodiments, it is to be appreciated that different, special, and/or unexpected results may be obtained from each member of the respective Markush group independent from all other Markush members. Each member of a Markush group may be relied upon individually and or in combination and provides adequate support for specific embodiments within the scope of the appended claims.

The present invention has been described herein in an illustrative manner, and it is to be understood that the terminology which has been used is intended to be in the nature of words of description rather than of limitation. Many modifications and variations of the present invention are possible in light of the above teachings. The present invention may be practiced otherwise than as specifically described within the scope of the appended claims. The subject matter of all combinations of independent and dependent claims, both single and multiple dependent, is herein expressly contemplated.

What is claimed is:

1. A contact element for electrical connection of an electrical plug-in connector of an electrical or electronic system component to an electronic printed board assembly, the contact element comprising:

two arms including a first arm and a second arm, wherein the two arms each have a circular free end, wherein the two arms are connected to one another via a contact portion, wherein, at one end, the contact element has an extension piece for the electrical connection to the printed board assembly, wherein the contact element has a cutout over its entire length, wherein the cutout is narrowed in the contact portion by contact projections projecting into the cutout;

wherein a clamping region for a force-fitting and electrically conductive clamping of the plug-in connector of the electrical or electronic system component is formed; and wherein the two arms are angled relative to the contact portion in such a way that the two arms extend in two different planes.

2. The contact element as claimed in claim 1, wherein the first arm and the second arm are aligned at an angle with respect to the contact portion of the contact element, each in an angular range of from 30° to 120°, including the range limits.

3. The contact element as claimed in claim 2, wherein the first arm is bent through 90° with respect to the contact portion of the contact element and extends approximately parallel to a plane of the electrical or electronic system component to be contacted, wherein the second arm is bent through 90° in the opposite direction to the first arm with respect to the contact portion and extends parallel to a plane of the printed board assembly, and wherein the plug-in connector can be plugged into the contact portion approximately perpendicularly to the two arms.

4. The contact element as claimed in claim 1, wherein the first arm and the second arm are aligned at same-sized or different-sized angles to the contact portion.

5. The contact element as claimed in claim 1, wherein, owing to the cutout in the contact element, the two arms and the contact portion in the contact element are each formed by two limbs, and wherein the geometry of the limbs and the ends of the two arms enables the contact element to generate a spring force which, in the region of the contact portion, acts on a plug-in connector of the electrical or electronic system component, which is received in the contact portion.

6. The contact element as claimed in claim 5, wherein, in the region of the contact portion, the limbs have insertion chamfers for easier insertion of the plug-in connector of the electrical or electronic system component into the contact element, and wherein the insertion chamfers narrow the cutout in the contact element continuously with a sloping progression.

7. The contact element as claimed in claim 1, wherein the contact element is arranged on a supporting element, wherein the ends of the arms are fixed on the supporting element by employing latching connections, and wherein the supporting element has at least one opening for guiding the plug-in connector of the electrical or electronic system component through into the contact portion of the contact element.

8. The contact element as claimed in claim 7, wherein a respective latching element of the supporting element is received in an annular end of the contact element.

9. The contact element as claimed in claim 1, wherein the extension piece on the contact element is formed for direct attachment to and contact with a component of the printed board assembly.

10. The contact element as claimed in claim 1, wherein the extension piece on the contact element is formed with an angle, wherein the angled portion is longer than the non-angled portion of the extension piece.

11. A contact device comprising a plurality of contact elements according to claim 1, wherein the plurality of contact elements are arranged for a plurality of electrical contacts or for a plurality of phases of an electrical contact, and wherein these contact elements are orientated in the same direction in terms of the angle of their arms so that their extension pieces point in the same direction.

12. A contact device having a plurality of contact elements according to claim 1, wherein a plurality of contact elements are arranged for a plurality of electrical contacts or for a plurality of phases of an electrical contact, and wherein these contact elements are orientated in opposite directions in terms of the angle of their arms so that their extension pieces point in opposite directions.

13. The contact element as claimed in claim 1, wherein the two arms and the contact portion are each formed by two limbs and a first limb of a first arm is connected to a first limb of a second arm via a first limb of a first contact portion and a second limb of a first arm is connected to a second limb of a second arm via a second limb of a second contact portion.

14. The contact element as claimed in claim 13, wherein the first limb of the first arm is connected in one piece to the first limb of the second arm via the first limb of the first contact portion and the second limb of the first arm is connected in one piece to the second limb of the second arm via the second limb of the second contact portion.

15. The contact element as claimed in claim 1, wherein the two arms are configured to be connected to one another in one piece via the contact portion.

16. The contact element as claimed in claim 1, wherein the two arms are connected to one another in one piece via the contact portion.

17. The contact element of claim 1, wherein the contact element comprises an electrically conductive material.

18. The contact element of claim 1, wherein the plug-in connector of the electrical or electronic system component is configured to be connected to the contact element in a force-fitting and electrically conductive manner as a result of a spring effect of the contact element.

19. The contact element of claim 1, wherein the electronic printed board assembly comprises a printed circuit board.

20. The contact element of claim 9, wherein the component of the printed board assembly comprises a lead frame.

* * * * *